US011890503B2

(12) United States Patent
Smith et al.

(10) Patent No.: US 11,890,503 B2
(45) Date of Patent: Feb. 6, 2024

(54) ANKLE DORSIFLEXION THERAPY DEVICE

(71) Applicant: GRASSROOTS PT EQUIPMENT, LLC, Salt Lake City, UT (US)

(72) Inventors: Esther Smith, Salt Lake City, UT (US); Brendan Perkins, Salt Lake City, UT (US)

(73) Assignee: GRASSROOTS PHYSICAL THERAPY LLC, Bozeman, MT (US)

( * ) Notice: Subject to any disclaimer, the term of this patent is extended or adjusted under 35 U.S.C. 154(b) by 317 days.

(21) Appl. No.: 17/405,576

(22) Filed: Aug. 18, 2021

(65) Prior Publication Data

US 2022/0054887 A1 Feb. 24, 2022

Related U.S. Application Data

(60) Provisional application No. 63/067,984, filed on Aug. 20, 2020.

(51) Int. Cl.

| | |
|---|---|
| ***A63B 23/08*** | (2006.01) |
| ***A63B 21/00*** | (2006.01) |
| ***A63B 23/035*** | (2006.01) |

(52) U.S. Cl.

CPC ..... *A63B 23/08* (2013.01); *A63B 21/00185* (2013.01); *A63B 21/154* (2013.01); *A63B 21/4011* (2015.10); *A63B 21/4034* (2015.10); *A63B 21/4035* (2015.10); *A63B 23/03508* (2013.01); *A63B 2225/09* (2013.01)

(58) Field of Classification Search

CPC ..... A63B 21/00185; A63B 21/4034; A63B 23/03508; A63B 2225/09; A63B 21/00072; A63B 21/00178; A63B 21/002–0023; A63B 21/151; A63B 21/154–157; A63B 21/40; A63B 21/4001; A63B 21/4011–4015; A63B 21/4023; A63B 21/4025; A63B 21/4033–4035; A63B 21/4039; A63B 2022/0094; A63B 23/04; A63B 23/08–085; A61H 2201/0157; A61H 2201/1269; A61H 2203/0406; A61H 1/0266; A61H 2201/1253; A61H 2201/1261; A61H 2201/164; A61H 2201/1642; A61H 2201/1676; A61H 2205/10; A61H 2205/102; A61H 2205/12

See application file for complete search history.

(56) References Cited

U.S. PATENT DOCUMENTS 4,807,874 A 2/1989 Little
4,846,461 A * 7/1989 Robards, Jr. ..... A63B 22/0076 482/145

(Continued)

FOREIGN PATENT DOCUMENTS

JP 04-041898 B2 2/2008

*Primary Examiner* — Joshua Lee
*Assistant Examiner* — Catrina A Letterman
(74) *Attorney, Agent, or Firm* — Workman Nydegger

(57) ABSTRACT

In one example, an apparatus includes a baseplate, a footplate connected to the baseplate, a heel support connected to the footplate, an instep securing device connected to the heel support or footplate, a calf attachment member configured to releasably attach to a leg of a user, and a first cord movably connected to the baseplate, the first cord terminating at its first end in a handle, and a second end of the first cord is configured to attach to the calf attachment member.

15 Claims, 4 Drawing Sheets

(56) References Cited

U.S. PATENT DOCUMENTS

| | | | | |
|---|---|---|---|---|
| 5,853,354 | A * | 12/1998 | Kubota | A63B 21/4025 482/80 |
| 6,063,013 | A | 5/2000 | Vathappallil | |
| 6,110,078 | A * | 8/2000 | Dyer | A61H 1/0266 482/121 |
| 6,206,807 | B1 * | 3/2001 | Cowans | A61H 1/0266 482/79 |
| 7,169,098 | B1 | 1/2007 | McGanty | |
| 7,297,091 | B2 | 11/2007 | Nushart | |
| 7,955,236 | B2 | 6/2011 | Digiovanni et al. | |
| 8,361,002 | B2 | 1/2013 | Branch | |
| 2005/0192168 | A1 * | 9/2005 | Wilcocks | A63B 21/4011 482/121 |
| 2005/0209067 | A1 * | 9/2005 | Backes | A61H 1/0266 482/92 |
| 2006/0058719 | A1 * | 3/2006 | Nushart | A61H 1/0266 602/32 |
| 2007/0219071 | A1 * | 9/2007 | Hamer | A63B 21/4015 482/79 |
| 2011/0160625 | A1 * | 6/2011 | Yefimov | A61H 1/0259 601/5 |
| 2011/0190096 | A1 * | 8/2011 | Clarke | A63B 23/04 482/4 |
| 2012/0190515 | A1 * | 7/2012 | Barry | A63B 21/055 482/139 |
| 2013/0023390 | A1 * | 1/2013 | Ree | A63B 23/0482 482/124 |
| 2020/0406093 | A1 * | 12/2020 | Tarkington | A63B 21/4049 |
| 2021/0245003 | A1 * | 8/2021 | Turner | A63B 21/023 |
| 2022/0287905 | A1 * | 9/2022 | Hannula | A61H 1/0266 |
| 2022/0346714 | A1 * | 11/2022 | Samec | A61H 1/024 |

* cited by examiner

ANKLE DORSIFLEXION THERAPY DEVICE

FIELD OF THE INVENTION

The present disclosure is generally concerned with devices and methods suitable for use in physical therapy and other applications. More specifically, at least some of the disclosed embodiments are concerned with a dorsiflexion therapy device.

BACKGROUND

Impaired ankle dorsiflexion may cause a host of local, and upstream, kinetic chain issues. For example, limited dorsiflexion often develops after ankle sprains, ankle/foot injuries or surgeries, and with ageing. Limited dorsiflexion may also occur due to genetic predisposition, and/or in connection with soft tissue shortening conditions. In many cases, the gait of a person may be altered, however slightly, to accommodate limited dorsiflexion in his/her ankle, or ankles. Limited dorsiflexion may, in turn, lead to abnormal mechanics at the knee, hip and spine/pelvis. Such abnormal mechanics may cause pain and dysfunction at these proximal motion segments. The same is true locally, at the ankle and foot. Troublesome issues such as joint stiffness and pain, calf tension, achilles tendinitis, plantar fasciitis, bunions, and hammer toe, are sometimes associated with limited ankle dorsiflexion.

ASPECTS OF SOME EXAMPLE EMBODIMENTS

It should be noted that the embodiments disclosed herein do not constitute an exhaustive summary of all possible embodiments, nor does this brief summary constitute an exhaustive list of all aspects of any particular embodiment(s). Rather, this brief summary simply presents selected aspects of some example embodiments. It should further be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular technical effect(s) or solution(s).

Disclosed embodiments are concerned with a dorsiflexion therapy device and associated methods. The dorsiflexion therapy device, which may be referred to herein simply as a 'device,' may help to increase ankle dorsiflexion in users who have limited range of motion due to an acute or chronic injury or biomechanical restrictions of the ankle joint and/or soft tissue restrictions. Example embodiments may be advantageous relative to conventional devices and methods inasmuch as such embodiments may be operated in such a way as to mimic manual manipulation techniques utilized by skilled physical therapists.

In terms of its functionality, one example embodiment of the device is configured to fix the heel of the user in a desired position in an X-Y plane, while also enabling translation and/or rotation of the tibia of the user with respect to X and/or Y reference axes whose vertex may be defined to be located at, or near, the heel of the user when the foot of the user is engaged with the device. In this way, the device may enable tibial bone anterior glide and, accordingly, active dorsiflexion of the ankle joint, since the position and/or orientation of the tibia of the user is adjustable, such as by rotation of the tibia about a Z axis defined by the ankle of the user, within the X-Y plane.

An example embodiment of the device may comprise a stationary baseplate to which a footplate, which may be rotatable relative to the baseplate, may be attached. An adjustable instep securing strap may be provided which operates in conjunction with a heel support surface of the footplate to retain the foot securely in place and the instep securing strap may also help to facilitate a talus bone posterior glide, while the dorsiflexion stretch is occurring.

Embodiments of the device may comprise various features that may enable the user to move and/or position his lower leg, foot, and/or, ankle. For example, a calf attachment member may be provided that is configured to be releasably attached to the calf of the user. A pair of pulleys, one of which may be connected to the calf attachment member, and the other of which may be positioned at, or near, the front of the baseplate, may be connected together by a cord that includes a handle. The user may pull on the handle to adjust the position of the tibia of the user in the X-Y plane relative to the baseplate and/or to the footplate. That is, for example, an upward force on the front cord by the user activates the device and provides active dorsiflexion of the ankle joint by pulling the calf of the user toward the front of the device. A simplified embodiment of this force routing system may include only the single pulley connected at or near the front of the baseplate and a cord routed around the pulley and connected to the pull handle on one end and the calf attachment member on the other. The calf attachment member may be configured to wrap completely around the calf and hold the position of the calf, or the calf attachment member may comprise a simple band that may be looped around the calf and held in place by friction while the front pull strap force is being applied.

As another example of a feature that may enable a user to move and/or position his lower leg, foot, and/or ankle, a footplate, which may or may not be rotatable, may be provided as part of the device and may enable changes to the angle of inclination of the foot of the user relative to the baseplate, which may be oriented in a generally horizontal position. Particularly, the footplate may be releasably fixed at various different inclined positions relative to a horizontal position and, in this way, the footplate may enable increases to the initial preset dorsiflexion for the user as range of motion improves over time.

In a final example of a feature that may enable a user to move and/or position his lower leg, foot, and/or ankle, a rear cord and secondary pull handle may be provided in some embodiments of the device. The rear cord and secondary pull handle may enable the instep securing strap to be loosened and tightened by the user in order to modulate the pressure that the instep securing strap is applying. The user may employ the instep securing strap in a static or dynamic condition depending upon whether the rear cord is locked or if the rear cord is set to be freely controlled by the pull handle which enables the user to control the amount of talus bone posterior gliding that occurs during the dorsiflexion stretch.

Example embodiments of the invention may provide a variety of advantages, although no particular advantage is required to be provided, nor is any particular advantage required to be provided by any particular embodiment. For example, the user may benefit from use of the device inasmuch as the device may allow the user to apply appropriate forces and subtle rolls and/or glides of the joint surfaces of the talocrural joint. Users need regular, daily to weekly application of mobilization and stretch to change limited dorsiflexion. Everyone from athletes, to sedentary people, to the elderly, and the youth, may benefit from use of the device if they have impaired dorsiflexion or posterior chain tissue restrictions. The construction of the device can mimic the manual therapy techniques of skilled practitioners and may be simple, safe, and effective, for the home user. Various other features and advantages of embodiments of the invention may be apparent to those of ordinary skill in the art having the benefit of this disclosure.

BRIEF DESCRIPTION OF THE DRAWINGS

The appended drawings contain figures of some example embodiments to further explain various aspects of the present disclosure. It will be appreciated that these drawings depict only some example embodiments of the disclosure and are not intended to limit its scope in any way. The disclosure will be described and explained with additional specificity and detail through the use of the accompanying drawings.

DETAILED DESCRIPTION OF SOME EXAMPLE EMBODIMENTS

Figure 1:
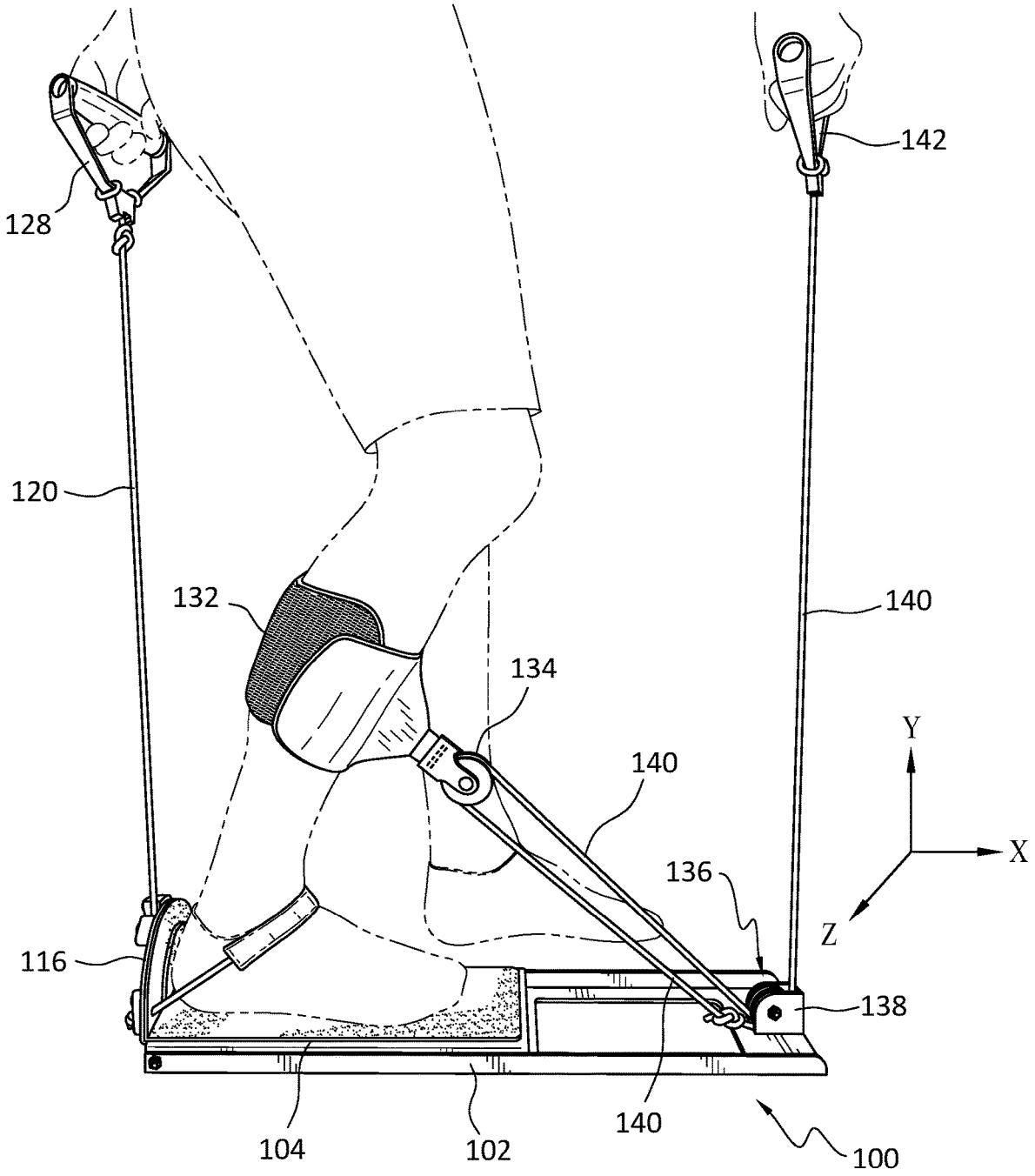
FIG. 1 is a side view disclosing how the device may be used to implement dorsiflexion while retaining the heel, and bottom of the foot, in a desired position

The present disclosure is generally concerned with devices and methods suitable for use in physical therapy and other applications. More specifically, at least some of the disclosed embodiments are concerned with a dorsiflexion therapy device.

A. General Aspects of Some Example Embodiments

In general, dorsiflexion therapy device components disclosed herein may be constructed with a variety of components and materials including, but not limited to, plastic including polycarbonates, rubber, polyester, cotton, synthetic polymers based on aliphatic or semi-aromatic polyamides and generically designated as 'Nylon,' composites, metals, and combinations of any of the foregoing. Suitable metals may include steel, aluminum, and aluminum alloys, although the skilled person will understand that a variety of other metals may be employed as well and the scope of the invention is not limited to the foregoing examples. Where metal is employed in the construction of a dorsiflexion therapy device, the metal elements may take one or more forms including, but not limited to, pipe, square tube, rectangular tube, round tube, pipe, angles, flatbar, I-shapes, T-shapes, L-shapes, and combinations and portions of any of the foregoing.

Depending upon the material(s) employed in the construction of the dorsiflexion therapy device, a variety of methods and components may be used to connect, releasably or permanently, various elements of the dorsiflexion therapy device. For example, the various elements of a dorsiflexion therapy device within the scope of this disclosure may be attached to each other by any one or more of allied processes such as welding or brazing, and/or mechanically by way of fasteners such as bolts, screws, pins, and rivets, for example.

Some, none, or all of portions of a dorsiflexion therapy device may be coated or otherwise covered with paint, rubber, plastic or other materials, or any combination of the foregoing. Surface treatments and textures, such as non-slip coatings for example, may also be applied to portions of the dorsiflexion therapy device.

Finally, the present disclosure may refer to various elements being connected to each other in various ways. Such elements may be connected directly to each other, or indirectly to each other. Where no particular connection is specified, the various elements may be connected either directly, or indirectly, to each other.

In the case of a direct connection, a first element may be releasably connected to a second element and held in that arrangement by one or more retaining elements such as a pin, sleeve, bolt, rivet, shaft, or stud, for example. Alternatively, and still with reference to the case of a direct connection, the first element and second element may be directly, and permanently, connected to each other such as by welding, brazing, sewing, or any other process that effects a connection between the elements that is intended to be permanent.

With reference to the case of an indirect connection, a first element may be indirectly connected to a second element by virtue of both of those elements being connected to one or more intervening elements. This indirect connection may be implemented by way of by one or more retaining elements such as a pin, sleeve, bolt, rivet, shaft, or stud, for example. Alternatively, and still with reference to the case of an indirect connection, the first element and second element may be indirectly, and permanently, connected to each other by way of one or more intervening elements to which the first element and second element are attached, such as by welding, brazing, sewing, or any other process that effects a permanent connection between the elements.

B. Context for Some Example Embodiments

Following is a brief discussion of some contextual considerations for embodiments of the invention. This discussion is not intended to limit the scope of the invention in any way.

In general, at least some example embodiments may be configured to improve ankle dorsiflexion and/or to stretch the soft tissues of the posterior compartment of the crus and plantar fascia. More generally, such embodiments may provide for joint mobilization, which may embrace, among other things, moving a joint through its range of motion, and gradually increasing the motion to free, or at least reduce, the restrictions at the joint.

As such, example embodiments may be configured to improve arthrokinematics movements of the ankle and/or foot and/or to stretch extra-articular soft tissues, such as at the ankle and/or foot. In connection with the foregoing, reference may be made herein to osteokinematics, or the gross movement that happens between two bones. This may occur because bone surfaces articulate at the joint. As well, reference may be made herein to arthrokinematics, or the small movements that occur at a joint surface. Arthrokinematic movements may include, for example, rolls, glides/slides, and spins. Example embodiments may facilitate appropriate, gentle rolls and slides of the talocrural joint, creating a way for a user to mobilize the ankle effectively at home.

It is noted that the talocrural joint is formed between the distal tibia-fibula and the talus, and is commonly referred to as the ankle joint. The distal and inferior aspect of the tibia, which may be referred to as the plafond, is connected to the fibula via tibiofibular ligaments forming a strong mortise which articulates with the talar dome distally. The talocrural joint is a hinge joint and allows for dorsiflexion and plantarflexion movements in the sagittal plane.

In more detail, the talus rolls within the mortise during dorsiflexion and plantarflexion. During dorsiflexion, the talus rolls anteriorly and it glides posteriorly. On the other hand, with plantarflexion, the talus rolls posteriorly and glides anteriorly. The reported normal available range for dorsiflexion varies in the literature between 0°-16.5° and 0°-25°, and this changes when in weightbearing (see, e.g., https://www.physio-pedia.com/Foot_and_Ankle_Structure-_and_Function).

C. Structural Aspects of Some Example Embodiments

Directing attention to FIGS. 1-4, aspects of an example dorsiflexion therapy device are disclosed. One particular example of a dorsiflexion therapy device is generally denoted at 100.

Figure 2:
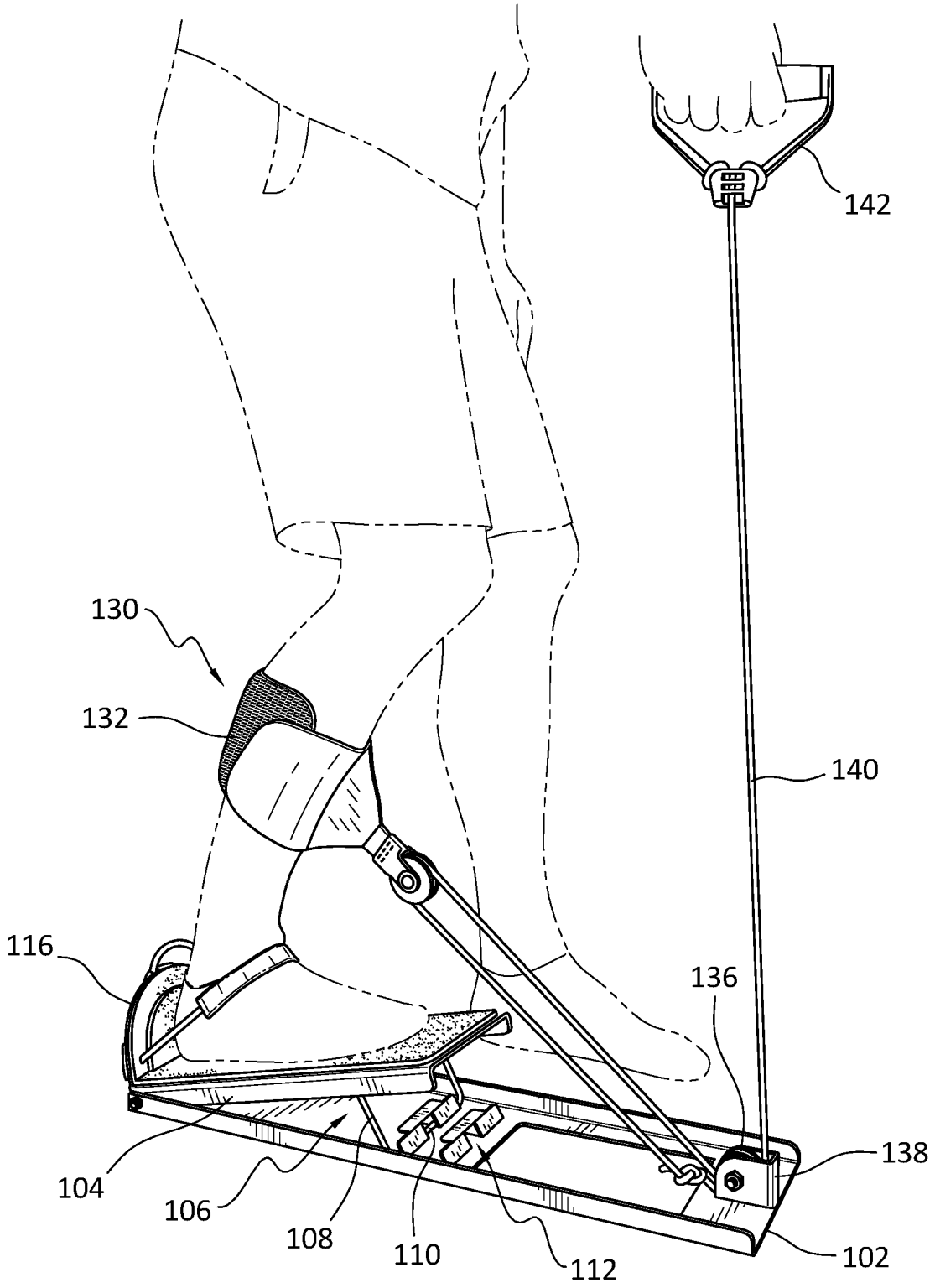
FIG. 2 is a side view disclosing the footplate in an inclined position while dorsiflexion is imposed.
Figure 3:
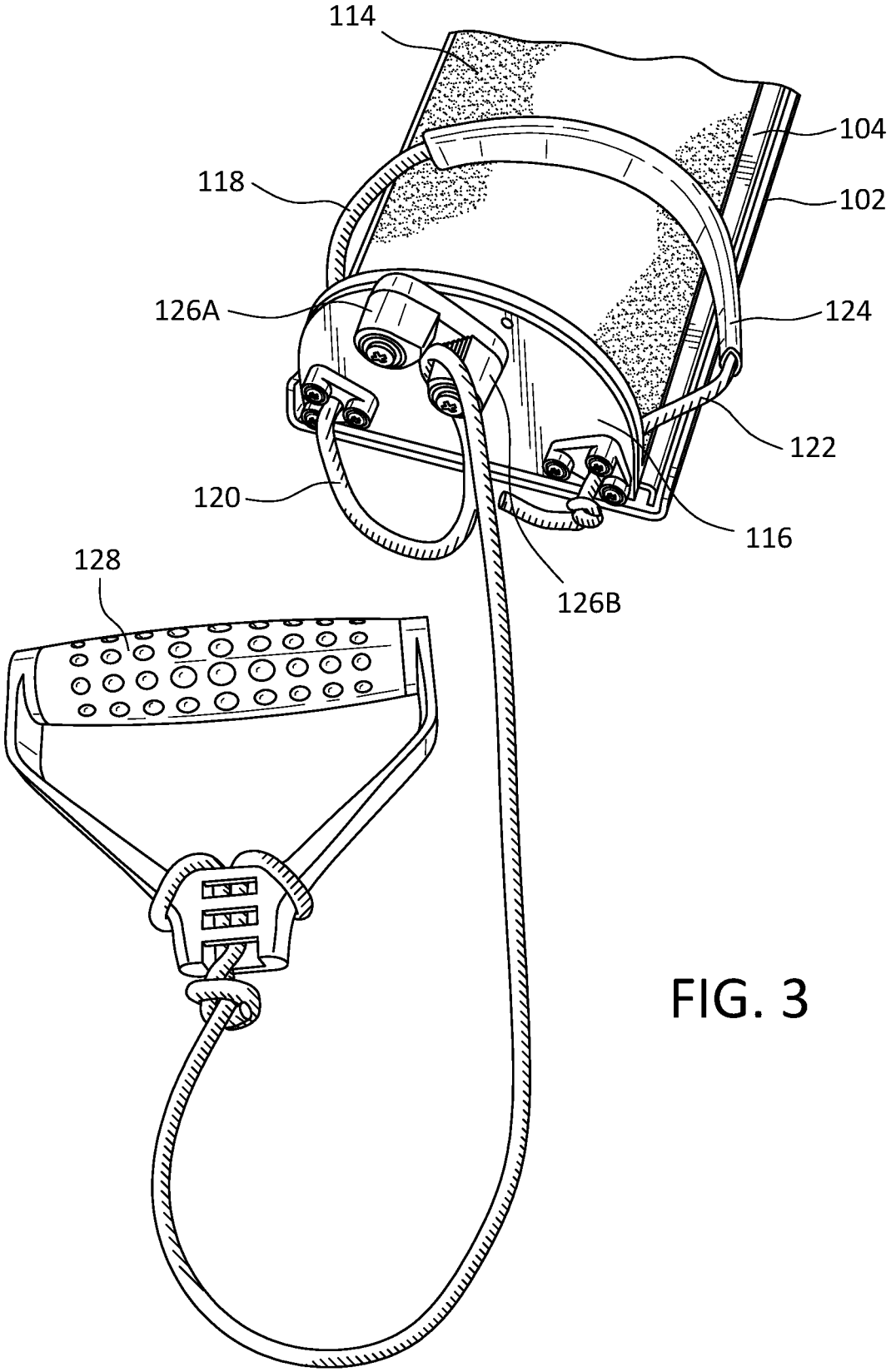
FIG. 3 is a perspective view disclosing various elements of an example embodiment of the device.
Figure 4:
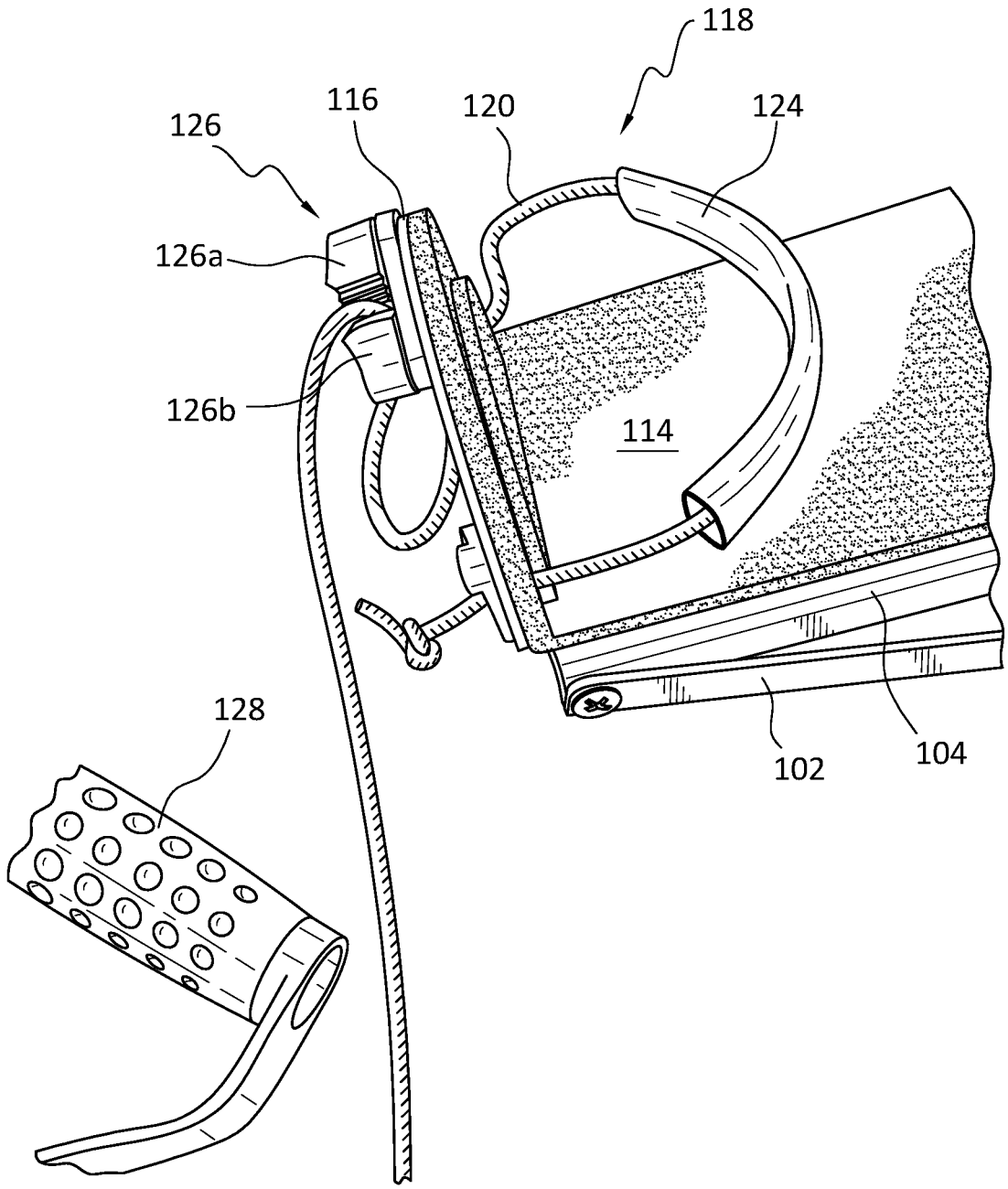
FIG. 4 is a perspective view disclosing particular aspects of an instep securing device.

The device 100 may include a baseplate 102 to which a footplate 104 may be attached, and both the baseplate 102 and footplate 104 may be metal. The footplate 104 may, or may not, be rotatable relative to the baseplate 102. In some embodiments, the footplate 104 may be omitted. Where the footplate 104 is provided, the footplate 104 may be adjustable so that it may be inclined, and releasably retained, at different angular positions relative to the baseplate 102, as seen by a comparison of the footplate 104 positions respectively shown in FIG. 1 (footplate 104 horizontal) and FIG. 2 (footplate 104 inclined). As best shown in FIG. 2, the footplate 104 may include an inclination adjustment mechanism 106 that may, for example, comprise a pair of arms 108 connected together by a crossbar 110 that can be positioned against one or more stops 112 on the baseplate 102. By adjusting the inclination adjustment mechanism 106 so that the crossbar 110 is positioned against one of the stops, the angle of inclination of the footplate 104 may be correspondingly adjusted. Any number of stops 112, corresponding to respective angles of inclination, may be provided in an embodiment. Finally, the footplate 104 and/or baseplate 102 may be provided with a surface treatment 114, such as a non-slip coating for example, that has a relatively high coefficient of friction so as to minimize any slippage or undesirable movement of the foot of the user when the foot is positioned on the footplate 104 or baseplate 102. In some embodiments, the surface treatment 114 may take the form of foam rubber, silicone, or similar material(s), and the surface treatment 114 may also be provided on the heel support 116.

With continued reference to the Figures, the device 100 may include a heel support 116, which may be attached to, or integral with, the footplate 104 or the baseplate 102. The heel support 116 may prevent rearward movement of the foot of the user when the foot is secured in position. In general, retention of the heel against the heel support 116 may be effected by an instep securing device 118 which may operate in conjunction with the heel support 116 to retain the foot securely in place, so as to help the user control the extent of talus bone posterior gliding that occurs during the dorsiflexion stretch. In some embodiments, the position of the heel support 116 may be adjustable so that the heel support 116 can move back and forth along the baseplate 102 and/or footplate 104, such as along a track (not shown) for example. Once positioned, the adjustable heel support 116 may be releasably locked into position with a locking mechanism (not shown).

In more detail, the instep securing device 118 may comprise a cord 120, or cable, that may pass through the heel support 116 so as to form a loop 122 through which a user may insert her foot. The loop 122 may be provided with a pad 124 to help prevent the cord 120 from chafing or injuring the foot of the user. The instep securing device 118 may further comprise a locking mechanism with which the cord 120 interfaces. In one embodiment, the locking mechanism comprises a ratchet mechanism 126 through which the cord 120 may pass so that when a user grasps the handle 128 attached to the end of the cord 120, the user can pull the cord 120 tight about his/her ankle, and lock the cord 120, as shown in FIG. 2 for example. The cord 120 may be connected to the heel support 116, the footplate 104, and/or, the baseplate 102, for example.

In this way, the user is not required to pull continuously on the cord 120 to keep the cord tight and the ankle in position. Instead, the user can simply pull the cord 120 tight and the ratchet mechanism 126 may lock the cord 120 into position until released by the user.

The ratchet mechanism 126 may be configured so that the ratchet elements **126*a* and 126*b* are biased toward each other, such as by a spring for example, to grip the cord 120. To improve the grip on the cord, the ratchet elements 126*a* and 126*b* may include grip elements (not shown), such as ridges or cross-hatching for example, arranged generally orthogonally to the direction in which the cord 120 travels between them. The user may manually release the cord 120 from the ratchet mechanism 126 by rotating, against the bias imposed by the spring, one or both of the ratchet elements 126*a* and 126*b* away from the cord 120**.

With continued reference to the Figures, the device 100 may also include a calf attachment member 130 that may comprise an adjustable cuff 132 to which a pulley 134 is connected. The cuff 132 may include hook-and-loop material (such as the material sold under the VELCRO® mark), or other mechanisms, to enable the diameter of the cuff 132 to be adjusted, and the cuff 132 to be tightened or loosened. The cuff 132 may be made of any suitable materials, including any textile or fabric, such as nylon, or cotton, for example, or any combination of materials. The pulley 134 may be clipped to the cuff 132 with a connector such as a buckle, or tab connector, so that the pulley 134 is removable from the cuff 132. Alternatively, the pulley 134 may be permanently connected to the cuff 132.

Another pulley 136 may be provided that may reside in a housing 138 attached to the baseplate 102. A cord 140, or cable, passes through the pulleys 134 and 136 and terminates with a handle 142 that may be grasped by a user. In the illustrated example, and as best shown in FIGS. 1 and 2, one end of the cord 140 is secured to the baseplate 102, and the cord 140 is then routed through the pulley 134, then through the pulley 136, and up, as shown in FIG. 1. The user may then grasp and pull the handle 142 to move the calf/tibia in the X-Y plane, about the Z axis, as shown in FIGS. 1 and 2. Thus, by adjusting the inclination of the footplate 104 and/or by pulling the handle 142 attached to the cord 140, the user may achieve, on a repeatable basis, the precise amount of dorsiflexion desired.

While the example of FIGS. 1 and 2 discloses two pulleys, 134 and 136, as part of a system to move the calf/tibia of the user and provide dorsiflexion, additional pulleys and/or pulleys of different diameters, may be employed in other embodiments in order to enable achievement, by the user, of a desired mechanical advantage for achieving the necessary dorsiflexion. Thus, the embodiment of FIGS. 1 and 2 is provided only by way of illustration, and is not intended to limit the scope of the invention in any way. In a simpler alternative embodiment, the cord 140 may be attached directly to the cuff 132, thus obviating the need for the secondary pulley 134. In a further example embodiment, the pulley 136 may be replaced by a low friction member that may be rigidly connected to the baseplate 102, in order to simplify the construction while also enabling the handle 142 and the cord 140 to route an applied force appropriately to achieve the desired amount of dorsiflexion. Such a low friction member may comprise, for example, a guide portion that may define a groove, which may have a generally U-shaped cross-section. The low friction member may alternatively take the form of a tube, or sheave. The low friction member may comprise low friction plastic such as polytetrafluoroethylene (PTFE), which may be sold under the TEFLON® mark, or polyoxymethylene (POM) thermoplastic, which may be sold under the DELRIN® mark. Any other plastic(s) and/or materials with properties similar to these example plastics may be employed. Another example material that may be employed in the low friction member is a polymer such as pDCPD (polydicyclopentadiene).

With particular attention to FIGS. 1 and 2, further aspects of some example embodiments are apparent. For example, it can be seen that as the cord 140 is pulled by the user, the pulley 134 may move closer to the pulley 136. Thus, the position of the pulley 134 in the X-Y plane may change. As well, when the cord 140 is pulled, the angle between the portion of the cord 140 between pulleys 134 and 136, and the baseplate 102, changes. Particularly, that angle may decrease since the pulley 134 has moved down in the Y direction. Conversely, when the user allows the handle 142 to travel down, the pulley 134 may move up in the Y direction.

D. Example Operational Aspects

In operation, a user may initially pass her foot through the loop defined by the cord 120 and position her foot on the footplate 104 so that her heel is near, or touching, the heel support 116. The user can then pull on the cord 120 using the handle 128 to releasably lock her heel against the heel support 116. Until the user is finished with the therapy session, there may be no further need for the cord 120, and so the cord 120 can be put on the floor out of the way, although it is still connected to the heel support 116.

With the heel thus secured, the user may then incline the footplate 104 at the desired inclination relative to horizontal. The footplate 104 may then be releasably locked into position at the desired inclination. In some instances however, such as when a user has very limited ankle mobility, the footplate 104 may be left in a horizontal, or near-horizontal position, for a therapy session. Next, the user may place the cuff 132 around her calf. The cuff 132 may be releasably secured in the desired position.

Finally, the user may the pull the cord 140 using the handle 142. Because the cord 140 is attached to the cuff 132, pulling or retracting the cord 140 will cause the lower leg of the user to move forward and down, that is, rotate, about a Z axis defined by the ankle. The user may readily select the extent of dorsiflexion to be achieved by simply varying the distance that the cord 140 is pulled upward. Note that the cord 140 need not be pulled directly upward at an angle of 90 degrees. Rather, the user may achieve a desired dorsiflexion by pulling the cord 140 at other angles greater, or less than, 90 degrees.

Some embodiments of the invention may comprise various indicia and/or measuring devices that may enable a user or other person to measure and/or determine, for example, how far one or both cords have been pulled relative to one or more reference points, an extent to which a lower leg of a user has rotated forward or backward, an angle of a lower leg of the user relative to a reference plane, and/or, an angular range through which a lower leg of the use has moved and/or is moving. Such indicia and measuring devices may be mechanical and/or electronic. Such indicia and measuring devices may comprise, for example, an inclinometer, bubble level, or protractor. Such indicia may comprise painted or inscribed marks on any element(s) of the device.

E. Advantageous Aspects of Some Embodiments

As will be apparent from the disclosure, one or more embodiments of the invention can provide one or more advantageous and unexpected effects, in any combination, some examples of which are set forth below. It should be noted that such effects enumerated herein are neither intended, nor should be construed, to limit the scope of the claimed invention in any way.

For example, one or more embodiments of the invention may be advantageous inasmuch as they enable to releasably lock her foot in a desired position in the X direction, such as up against a heel support. An embodiment of the invention may employ the mechanical advantage enabled by one or more pulleys to achieve a desired dorsiflexion. An embodiment may provide a variable angle of inclination for the foot of the user, in combination with a pulley system, to achieve a desired dorsiflexion. An embodiment of the invention may be operable to mimic manual manipulation techniques utilized by skilled physical therapists, thus enabling an unskilled user to perform effective dorsiflexion therapy in a home environment, for example. An embodiment of the invention may enable achievement of benefits associated with improved ankle mobilization. An embodiment of the invention may enable stretching of the calf of the user, in addition to ankle mobilization. An embodiment of the invention may help to reduce or eliminate conditions which may be associated with poor dorsiflexion, such as plantar fasciitis for example. An embodiment of the invention may be simple to set up and use. An embodiment of the invention may be portable.

F. Some Further Example Embodiments

Embodiment 1. An apparatus, comprising: a baseplate; a footplate connected to the baseplate; a heel support connected to the footplate; an instep securing device connected to the heel support or footplate; a calf attachment member configured to releasably attach to a leg of a user; and a first cord movably connected to the baseplate and terminating at its first end in a handle, and a second end of the cord is configured to attach to the calf attachment member.

Embodiment 2. The apparatus as recited in embodiment 1, wherein the footplate is rotatable to assume a plurality of different inclined positions relative to the baseplate.

Embodiment 3. The apparatus as recited in any of embodiments 1-2, wherein when the calf attachment member is attached to the lower leg of the user, and the first cord is pulled upward by the user, the lower leg of the user is pulled forward, rotating about an ankle of the user.

Embodiment 4. The apparatus as recited in any of embodiments 1-3, wherein when the first cord is pulled upward by the user, the lower leg of the user rotates in an X-Y plane.

Embodiment 5. The apparatus as recited in embodiment 1, wherein the calf attachment member comprises a cuff configured to receive a portion of the leg of the user.

Embodiment 6. The apparatus as recited in any of embodiments 1-5, further comprising a pulley mounted at least indirectly to the baseplate, and the first cord is configured to pass through the pulley.

Embodiment 7. The apparatus as recited in any of embodiments 1-6, wherein the instep securing device comprises: a second cord configured to pass through the heel support or footplate so as to define a loop configured to receive a portion of a foot of the user; and a locking mechanism, wherein the second cord is configured to pass through the locking mechanism so as to releasably lock a heel of a user to the heel support.

Embodiment 8. The apparatus as recited in embodiment 7, wherein one end of the second cord is connected to the heel support or footplate, and a handle is attached to the other end of the second cord.

Embodiment 9. The apparatus as recited in any of embodiments 7-8, wherein the apparatus is configured to enable the user to pull both the first cord and the second cord at the same time.

Embodiment 10. An apparatus, comprising: a baseplate; a footplate connected to the baseplate; a heel support connected to the footplate; an instep securing device connected to the heel support or footplate; a calf attachment member configured to releasably attach to a leg of a user, and the calf attachment member including a first pulley; and a first cord movably connected to the baseplate and configured to pass through the first pulley, the first cord terminating at its first end in a handle, and a second end of the first cord is configured to attach to the baseplate.

Embodiment 11. The apparatus as recited in embodiment 10, wherein the calf attachment member comprises a cuff to which the first pulley is connected, and the cuff is configured to receive a portion of the leg of the user.

Embodiment 12. The apparatus as recited in any of embodiments 10-11, wherein when the first cord is pulled upward by the user, the lower leg of the user is pulled forward, rotating about the ankle of the user.

Embodiment 13. The apparatus as recited in any of embodiments 10-12, wherein when the first cord is pulled upward by the user, the lower leg of the user rotates in an X-Y plane.

Embodiment 14. The apparatus as recited in any of embodiments 10-13, further comprising a second pulley mounted at least indirectly to the baseplate, and the first cord is configured to pass through the second pulley.

Embodiment 15. The apparatus as recited in any of embodiments 10-14, wherein the instep securing device comprises: a second cord configured to pass through the heel support or footplate so as to define a loop configured to receive a portion of a foot of the user; and a locking mechanism, wherein the second cord is configured to pass through the locking mechanism so as to releasably lock a heel of a user to the heel support.

Embodiment 16. The apparatus as recited in embodiment 15, wherein one end of the second cord is connected to the heel support or footplate, and a handle is attached to the other end of the second cord.

Embodiment 17. The apparatus as recited in any of embodiments 15-16, wherein the apparatus is configured to enable the user to pull both the first cord and the second cord at the same time.

Embodiment 18. The apparatus as recited in any of embodiments 1-17, further comprising indicia and/or a measuring device, wherein the indicia and/or measuring device enable measurement of an aspect relating to position and/or movement of the leg of the user.

Although this disclosure has been described in terms of certain example embodiments, other embodiments apparent to those of ordinary skill in the art are also within the scope of this disclosure.

What is claimed is:

1. An apparatus, comprising:

a baseplate;

a footplate connected to the baseplate;

a heel support connected to the footplate;

an instep securing device connected to the heel support or the footplate;

a calf attachment member; and a first cord movably connected to the baseplate, the first cord terminating at its first end in a handle, and a second end of the first cord is configured to attach to the calf attachment member, wherein the calf attachment member is configured to be releasably attached to a lower leg of a user, and the calf attachment member is further configured to, in response to an upward pull on the first cord, pull the lower leg of the user forward and rotate the lower leg of the user about an ankle of the user.

2. The apparatus as recited in claim 1, wherein the footplate is rotatable to assume a plurality of different inclined positions relative to the baseplate.

3. The apparatus as recited in claim 1, wherein the first cord is configured to be pulled upward by the user to rotate the lower leg of the user in an X-Y plane.

4. The apparatus as recited in claim 1, wherein the calf attachment member comprises a cuff configured to receive a portion of the leg of the user.

5. The apparatus as recited in claim 1, further comprising a pulley mounted to the baseplate by way of a housing, and the first cord is configured to pass through the pulley.

6. The apparatus as recited in claim 1, wherein the instep securing device comprises;

a second cord configured to pass through the heel support or footplate so as to define a loop configured to receive a portion of a foot of the user; and a locking mechanism, wherein the second cord is configured to pass through the locking mechanism so as to releasably lock a heel of a user to the heel support.

7. The apparatus as recited in claim 6, wherein one end of the second cord is connected to the heel support or footplate, and a handle is attached to the other end of the second cord.

8. The apparatus as recited in claim 6, wherein the apparatus is configured to enable the user to pull both the first cord and the second cord at the same time.

9. An apparatus, comprising:

a baseplate;

a footplate connected to the baseplate;

a heel support connected to the footplate;

an instep securing device connected to the heel support or the footplate;

a calf attachment member configured to releasably attach to a leg of a user, and the calf attachment member including a first pulley; and a first cord configured to pass through the first pulley, the first cord terminating at its first end in a handle, and a second end of the first cord is configured to attach to the baseplate, wherein the first cord is configured, in response to an upward pull on the first cord, to pull a lower leg of the user forward and to rotate the lower leg of the user about an ankle of the user.

10. The apparatus as recited in claim 9, wherein the calf attachment member comprises a cuff to which the first pulley is connected, and the cuff is configured to receive a portion of the leg of the user.

11. The apparatus as recited in claim 9, wherein the first cord is configured to be pulled upward by the user to rotate the lower leg of the user in an X-Y plane.

12. The apparatus as recited in claim 9, further comprising a second pulley mounted to the baseplate by way of a housing, and the first cord is configured to pass through the second pulley.

13. The apparatus as recited in claim 9, wherein the instep securing device comprises;

a second cord configured to pass through the heel support or footplate so as to define a loop configured to receive a portion of a foot of the user; and a locking mechanism, wherein the second cord is configured to pass through the locking mechanism so as to releasably lock a heel of a user to the heel support.

14. The apparatus as recited in claim 13, wherein one end of the second cord is connected to the baseplate, and a handle is attached to the other end of the second cord.

15. The apparatus as recited in claim 13, wherein the apparatus is configured to enable the user to pull both the first cord and the second cord at the same time.

* * * * *